US009398785B2

(12) United States Patent
Horacek

(10) Patent No.: US 9,398,785 B2
(45) Date of Patent: Jul. 26, 2016

(54) SHOE, ESPECIALLY SPORTS SHOE

(75) Inventor: Raymond Alfred Horacek, Tokyo (JP)

(73) Assignee: PUMA SE, Herzogenaurach (DE)

( * ) Notice: Subject to any disclaimer, the term of this patent is extended or adjusted under 35 U.S.C. 154(b) by 388 days.

(21) Appl. No.: 14/342,511

(22) PCT Filed: Mar. 9, 2012

(86) PCT No.: PCT/EP2012/001058

§ 371 (c)(1),
(2), (4) Date: Mar. 3, 2014

(87) PCT Pub. No.: WO2013/131533

PCT Pub. Date: Sep. 12, 2013

(65) Prior Publication Data

US 2014/0223778 A1 Aug. 14, 2014

(51) Int. Cl.

| | |
|---|---|
| ***A43B 13/14*** | (2006.01) |
| ***A43B 7/32*** | (2006.01) |
| ***A43B 13/18*** | (2006.01) |

(Continued)

(52) U.S. Cl.

CPC ..... *A43B 7/32* (2013.01); *A43B 3/0036* (2013.01); *A43B 5/06* (2013.01); *A43B 13/141* (2013.01); *A43B 13/181* (2013.01)

(58) Field of Classification Search

CPC ..... A43B 7/32; A43B 13/181; A43B 13/141; A43B 13/16; A43B 13/18

USPC ..... 36/102, 103, 25 R

See application file for complete search history.

(56) References Cited

U.S. PATENT DOCUMENTS 1,964,406 A * 6/1934 Pellkofer ..... A43B 3/128 36/11.5
2,304,957 A * 12/1942 Roth ..... A43B 13/08 16/382

(Continued)

FOREIGN PATENT DOCUMENTS

| | | | |
|---|---|---|---|
| DE | 261 483 | C | 10/1912 |
| FR | 877 167 | A | 11/1942 |
| WO | 2011/109541 | A1 | 9/2011 |

*Primary Examiner* — Ted Kavanaugh

(74) *Attorney, Agent, or Firm* — Lucas & Mercanti, LLP

(57) ABSTRACT

The invention relates to a shoe (1), especially to a sports shoe, having a shoe upper (2) and a sole (3) which is connected with the shoe upper (2), wherein the sole (3) has a longitudinal axis (L) and has a forefoot region (4), a midfoot region (5) and a rearfoot region (6). To support the foot especially during running in a more natural way the invention is characterized in that at least one first hinge (7) is provided in the sole (3) being located between the forefoot region (4) and the midfoot region (5), which first hinge (7) allows a bending of the forefoot region (4) relatively to the midfoot region (5) around a first horizontal axis ($T_1$) perpendicular to the longitudinal axis (L), and that at least one second hinge (8) is provided in the sole (3) being located in the midfoot region (5), which second hinge (8) allows a bending of two adjacent parts (5*a*, 5*b*) of the midfoot region (5) around a second horizontal axis ($T_2$) perpendicular to the longitudinal axis (L), wherein at least one elastic tensioning element (9) is arranged at or in the sole (3), which biases the forefoot region (4) to pivot around the first horizontal axis ($T_1$) upwards relatively to the midfoot region (5) when the shoe is standing on the ground (10) and which biases the two parts (5*a*, 5*b*) of the midfoot region (5) to pivot around the second horizontal axis ($T_2$) to form an arch when the shoe is standing on the ground (10).

15 Claims, 13 Drawing Sheets

Figure 1:
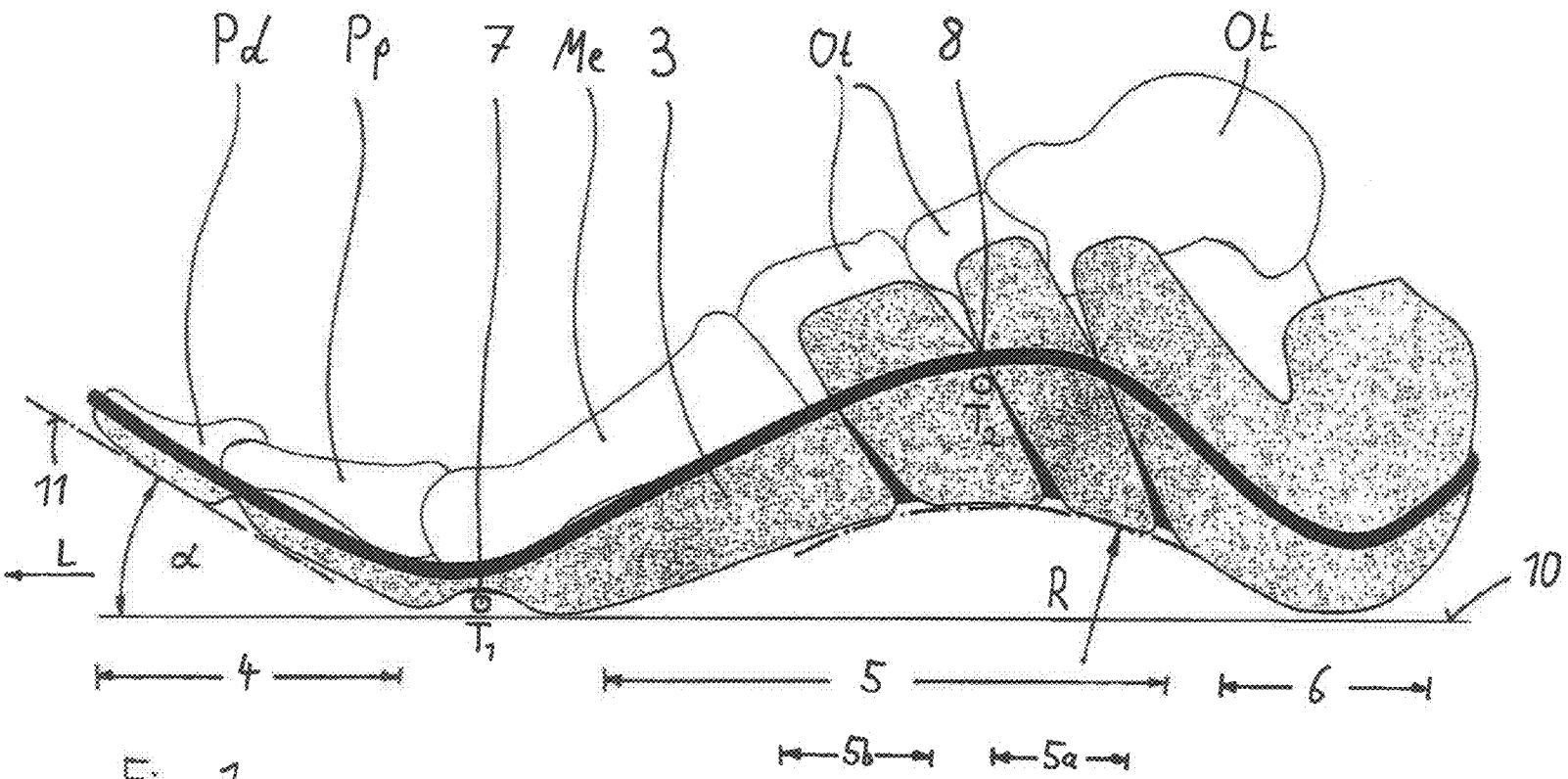

(51) Int. Cl.
*A43B 3/00* (2006.01)
*A43B 5/06* (2006.01)

(56) References Cited

U.S. PATENT DOCUMENTS 2,342,188 A * 2/1944 Ghez ..... A43B 13/08 36/141
5,311,680 A * 5/1994 Comparetto ..... A43B 7/14 36/140
5,481,814 A * 1/1996 Spencer ..... A43B 7/00 36/103
6,189,239 B1 * 2/2001 Gasparovic ..... A43B 3/30 36/102
8,505,220 B2 * 8/2013 James ..... A43B 13/141 36/102
2003/0033730 A1 2/2003 Burke et al.
2007/0251126 A1 * 11/2007 Tvoua ..... A43B 3/108 36/97
2007/0266598 A1 * 11/2007 Pawlus ..... A43B 13/141 36/102
2014/0165428 A1 * 6/2014 Freschi ..... A43B 13/141 36/102
2015/0143722 A1 * 5/2015 Faggin ..... A43B 3/108 36/25 R

* cited by examiner

SHOE, ESPECIALLY SPORTS SHOE

CROSS-REFERENCE TO RELATED APPLICATIONS

This application is a 371 of PCT/EP2012/001058 filed Mar. 9, 2012, the priority of which is hereby claimed and which is incorporated by reference herein.

The invention relates to a shoe, especially to a sports shoe, having a shoe upper and a sole which is connected with the shoe upper, wherein the sole has a longitudinal axis and has a forefoot region, a midfoot region and a rearfoot region.

Sport shoes for running must support the foot of the wearer of the shoe in a complex way. The foot of the runner changes its shape constantly during the different phases of each stride. In general, apart from elastic properties of the material of the shoe, the shoe supports the foot in a constant manner. Thus, the shoe can be designed to support the foot in a certain phase of the stride in an optimum way, but can be restrictive with regard to other phases of the stride. Those restrictions reduce the wearing comfort of the shoe. Also, the efficiency of the run can be reduced by the restrictions given by the shoe.

Thus, it is an object of the invention to propose a shoe, especially a sport shoe and specifically a running shoe which allows a better and optimized support of the foot of the wearer in the different phases of a stride. So, the wearing comfort of the shoe should be enhanced. The efficiency of the running process should also be improved.

The solution of this object according to the invention is characterized in that at least one first hinge is provided in the sole being located between the forefoot region and the midfoot region, which first hinge allows a bending of the forefoot region relatively to the midfoot region around a first horizontal axis perpendicular to the longitudinal axis, and that at least one second hinge is provided in the sole being located in the midfoot region, which second hinge allows a bending of two adjacent parts of the midfoot region around a second horizontal axis perpendicular to the longitudinal axis, wherein at least one elastic tensioning element is arranged at or in the sole, which biases the forefoot region to pivot around the first horizontal axis upwards relatively to the midfoot region when the shoe is standing on the ground and which biases the two parts of the midfoot region to pivot around the second horizontal axis to form an arch when the shoe is standing on the ground.

Preferably, the tensioning element is a rubber band. The rubber band can have a circular cross section. It can have a diameter between 2 mm and 7 mm, preferably between 3 mm and 5 mm.

The forefoot region can have a tangent in the front end of the sole—seen in a side view—, wherein an angle is arranged between the tangent and the ground, which angle is between 15° and 40°, preferably between 20° and 30°, when the shoe is in a loadfree status and standing on the ground.

The two adjacent parts of the midfoot region can limit a radius of curvature, wherein the radius of curvature is between 15% and 35%, preferably between 20% and 30%, of the length of the sole, when the shoe is in a loadfree status and standing on the ground.

The rubber band is preferably guided at least partially in channels or grooves which are formed in or on the sole.

It can be guided substantially in the shape of an eight seen in a top plan view of the sole.

At least one third hinge can be arranged in the forefoot region, which third binge allows a bending of sections of the forefoot region relatively to another around a third horizontal axis perpendicular to the longitudinal axis.

Furthermore, at least one fourth hinge can be arranged in the midfoot region, which fourth hinge allows a bending of sections of the midfoot region relatively to another around a fourth horizontal axis perpendicular to the longitudinal axis.

The rubber band can be guided from the rearfoot region to the front end of the sole, wherein the rubber band is turned at the front end of the sole and runs back in the direction of the rearfoot region along a defined extension. In this case, the turned rubber band can run below the rubber band which is coming from the rearfoot region. Alternatively, the turned rubber band can run in or on the shoe upper. The location where the rubber band is redirected needs not necessarily to be the frontmost position of the sole. This location can also be distanced from the frontmost position (e.g. 5% to 15% of the whole length of the sole).

The rubber band is preferably a closed band. It can be equipped with means to change the effective length of the band to adjust the bending effect of the rubber band to a desired level.

The sole can have at least one further groove being formed in the bottom surface of the sole and running substantial in the longitudinal direction of the shoe, which groove forms a hinge for pivoting a part of the sole relatively to another part of the sole around the longitudinal direction of the shoe.

Thus, when the sole is bent during contacting of the ground there is also a certain expansion of the sole in the longitudinal direction. This enhances also the comfort and efficiency of the use of the shoe.

According to the invention the shoe is able to expand and to contract together with the foot according to the actual deformations which are caused by the forces acting on the foot. Thus, the shoe can adapt itself to the actual form of the foot. That is, the shoe and the sole respectively moves together with the foot to best support the foot of the wearer during each different phase of the stride. By doing so, the natural spring ability of the foot is magnified.

Thus, the elastic tensioning element moves the sole—when no outer forces are acting—into a position which corresponds to the natural form of the foot in the propulsion phase (toe-off phase) of a stride.

The last for production of the described shoe is specially formed. Namely, the last is so formed to represent the propulsion phase (toe-off phase) of the foot motion during running.

In the drawings embodiments of the invention are shown.

Figure 2:
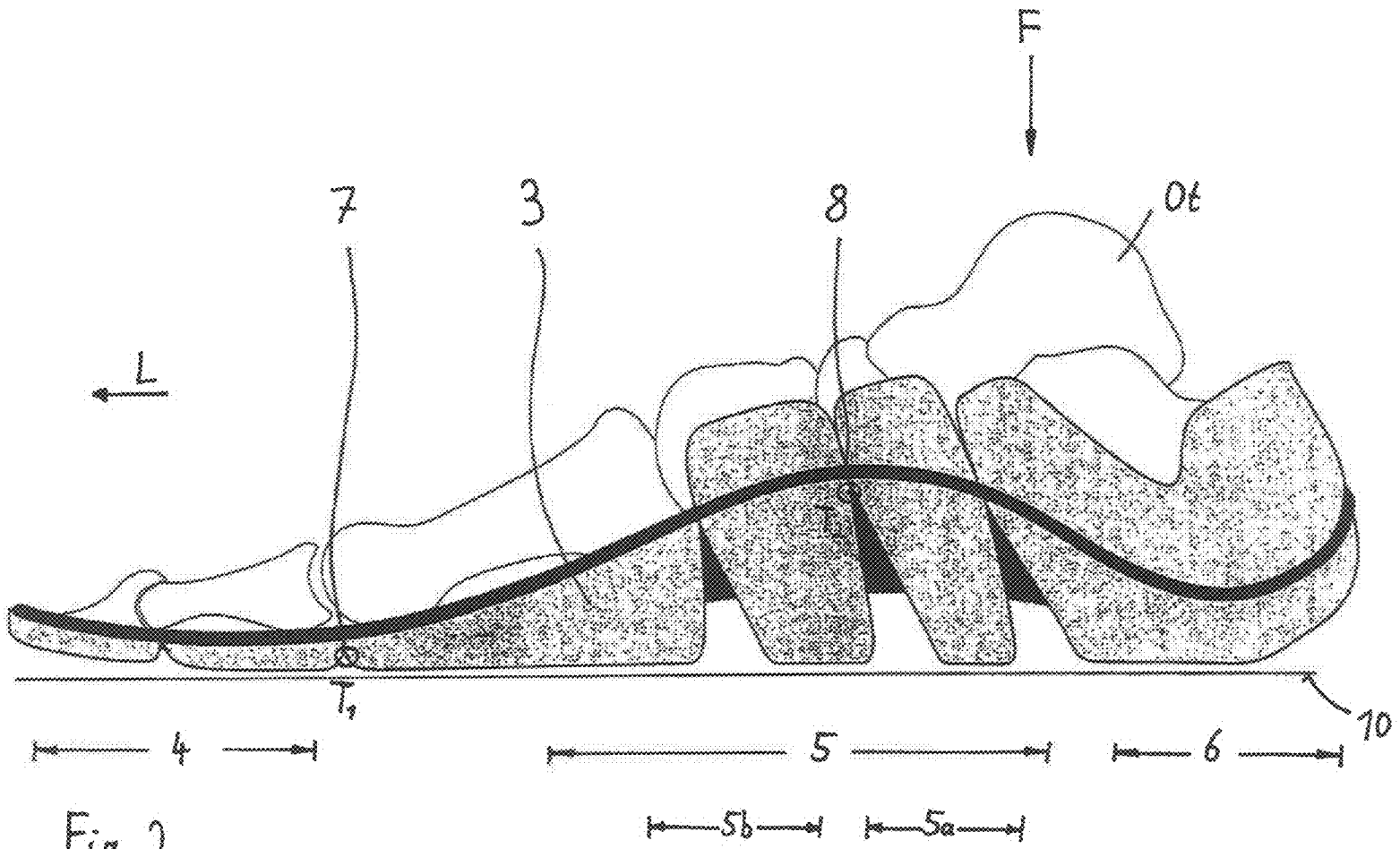
Figure 3:
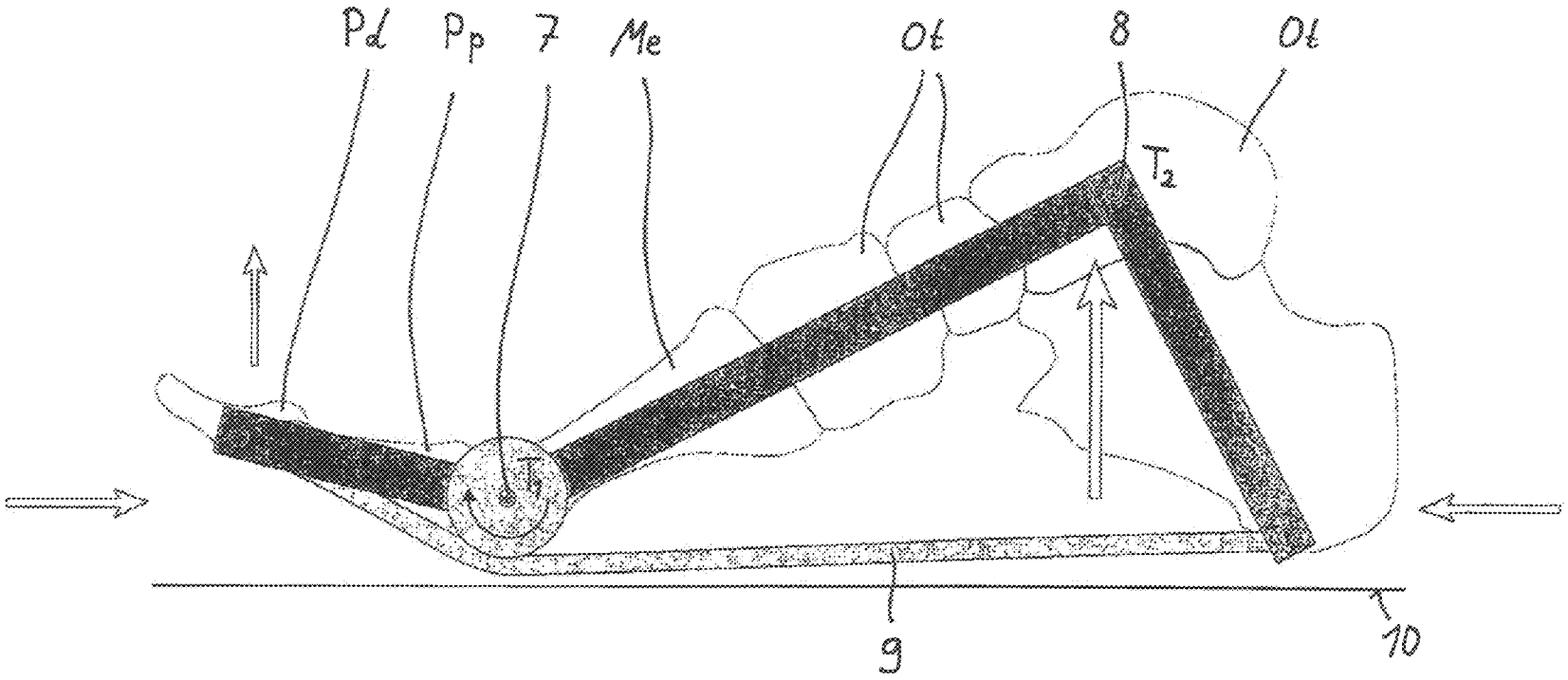
Figure 4:
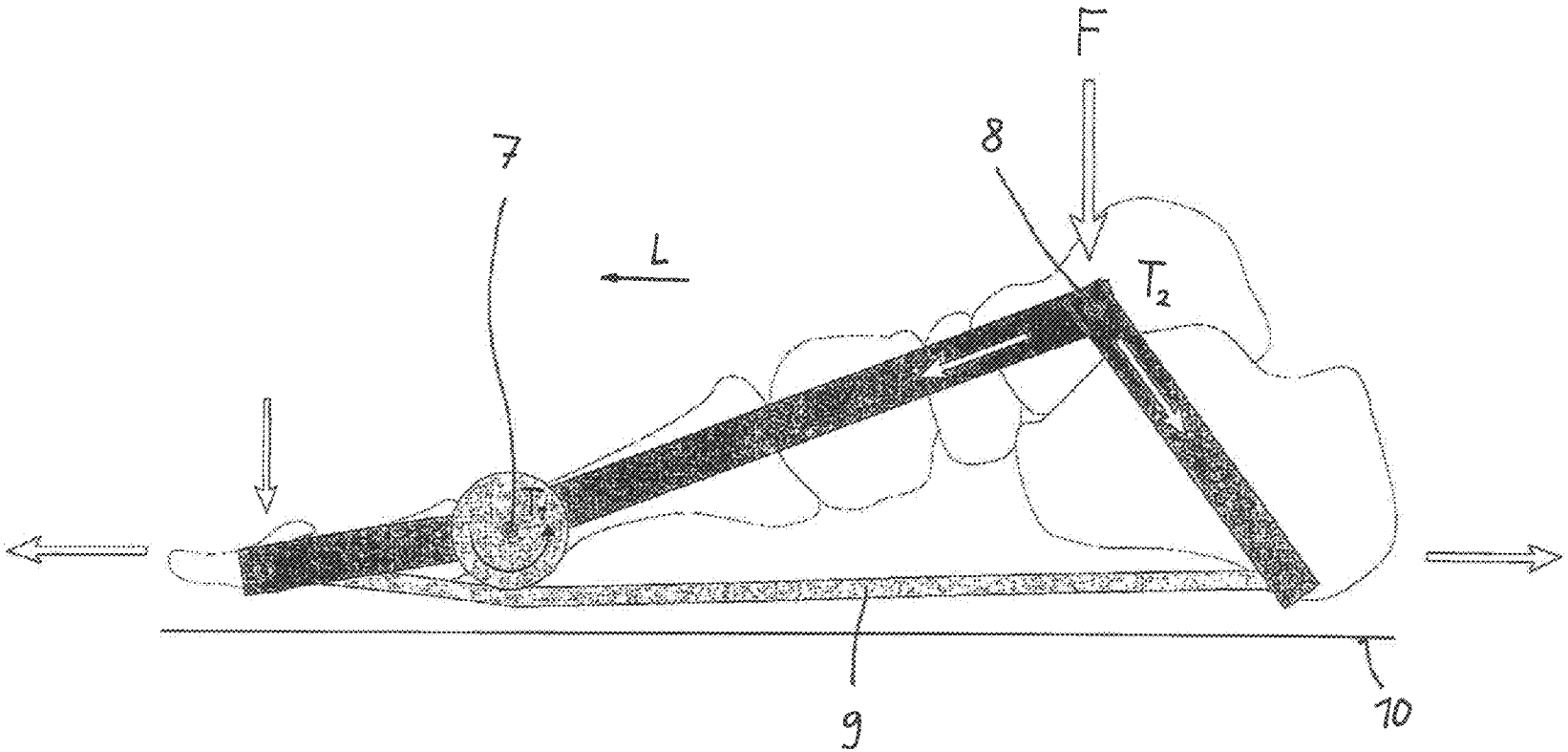
Figures 5A, 5B:
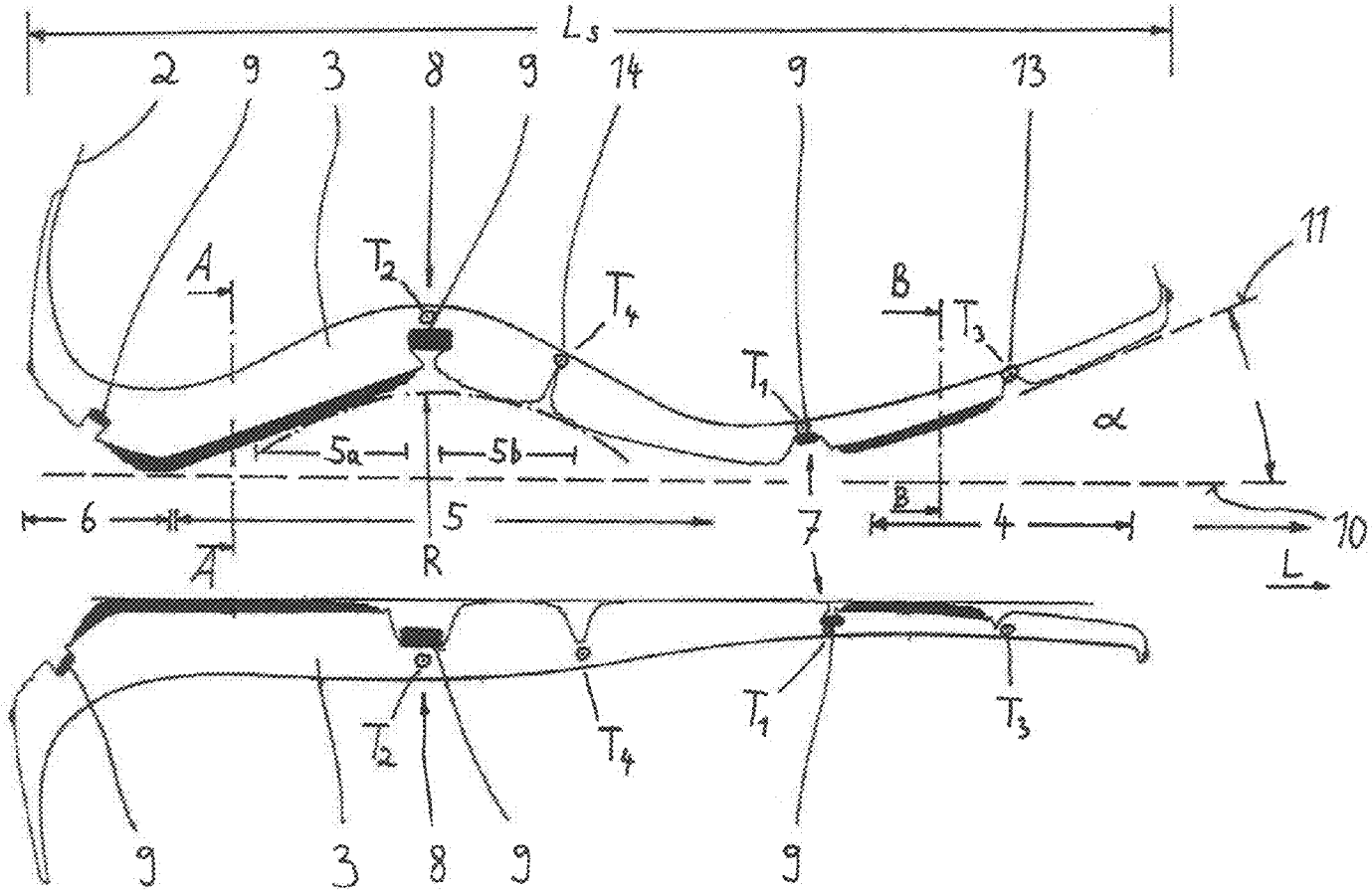
Figure 7:
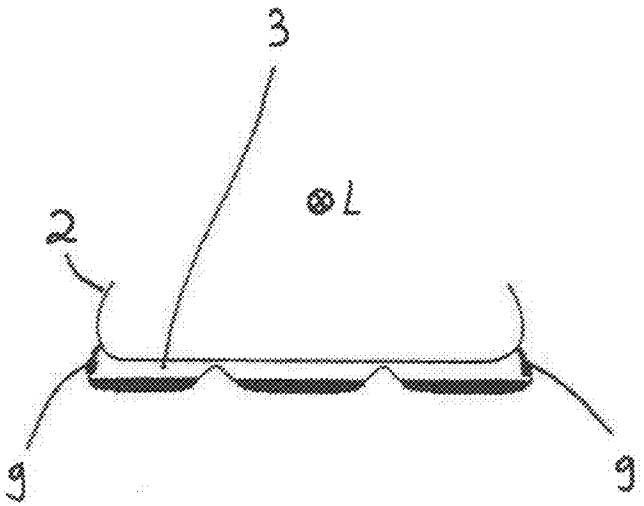
Figure 6:
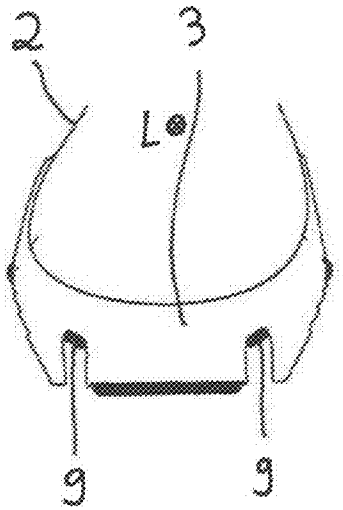
Figure 8:
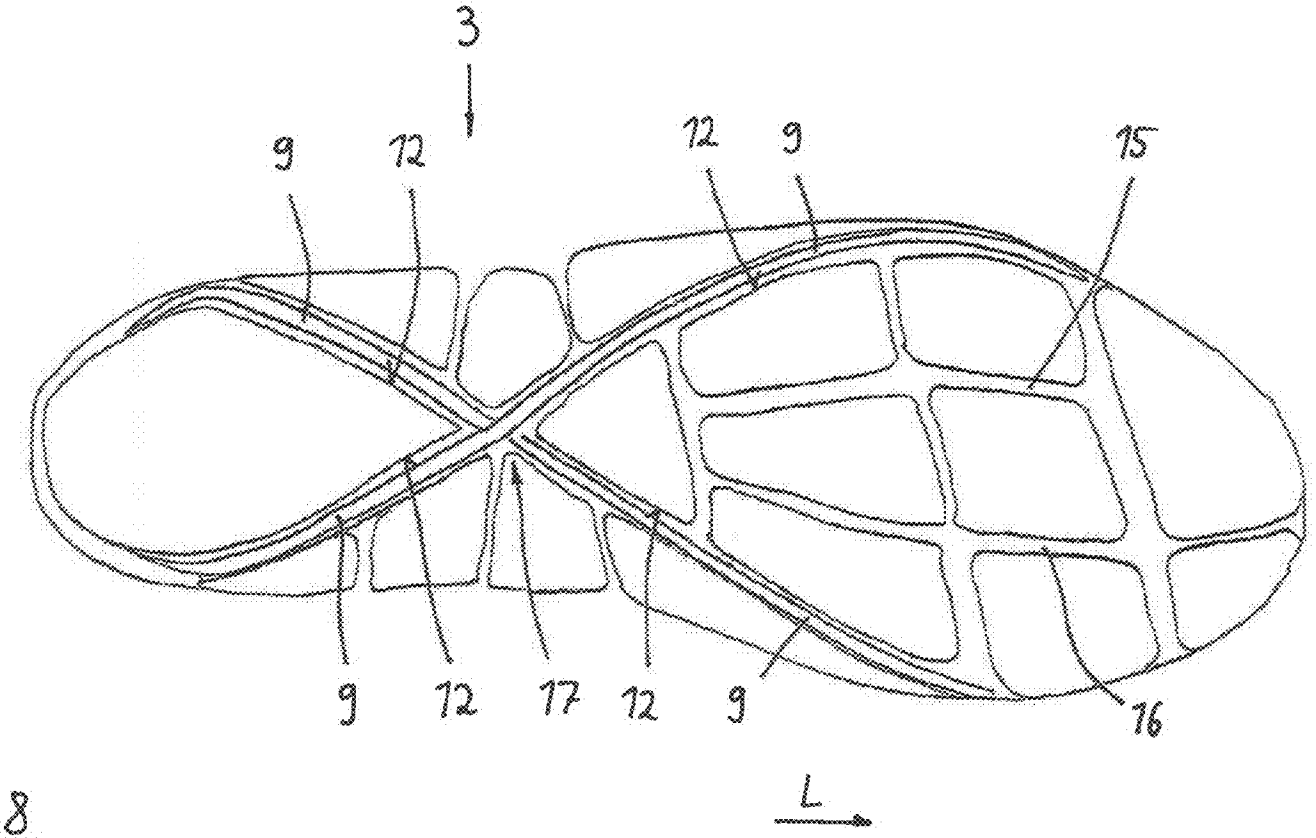
Figure 9:
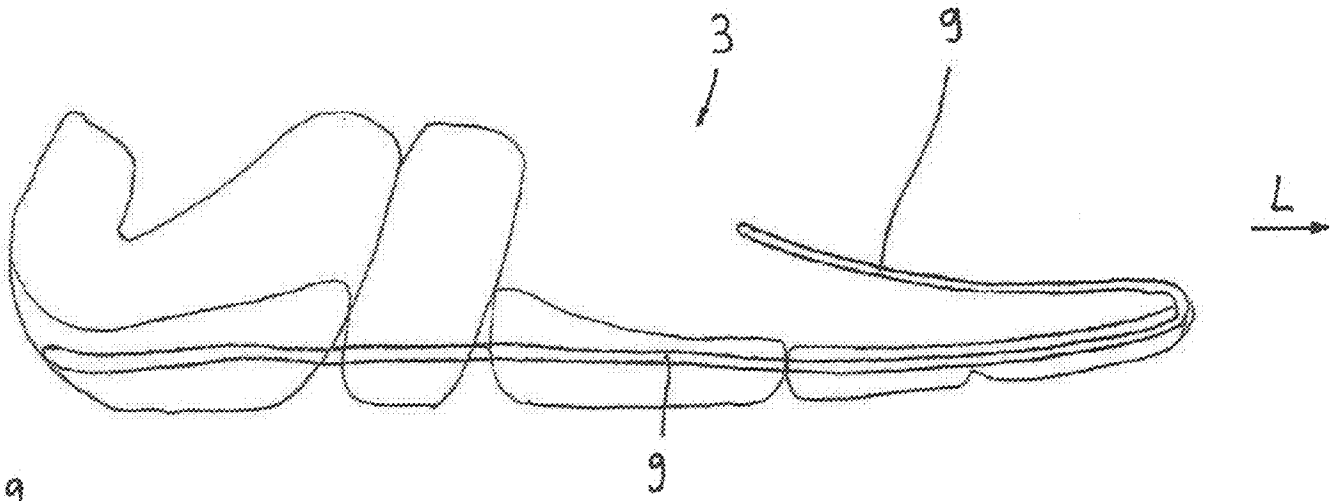
Figure 10:
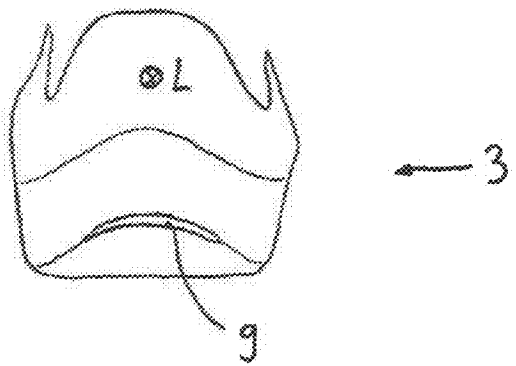
Figure 11:
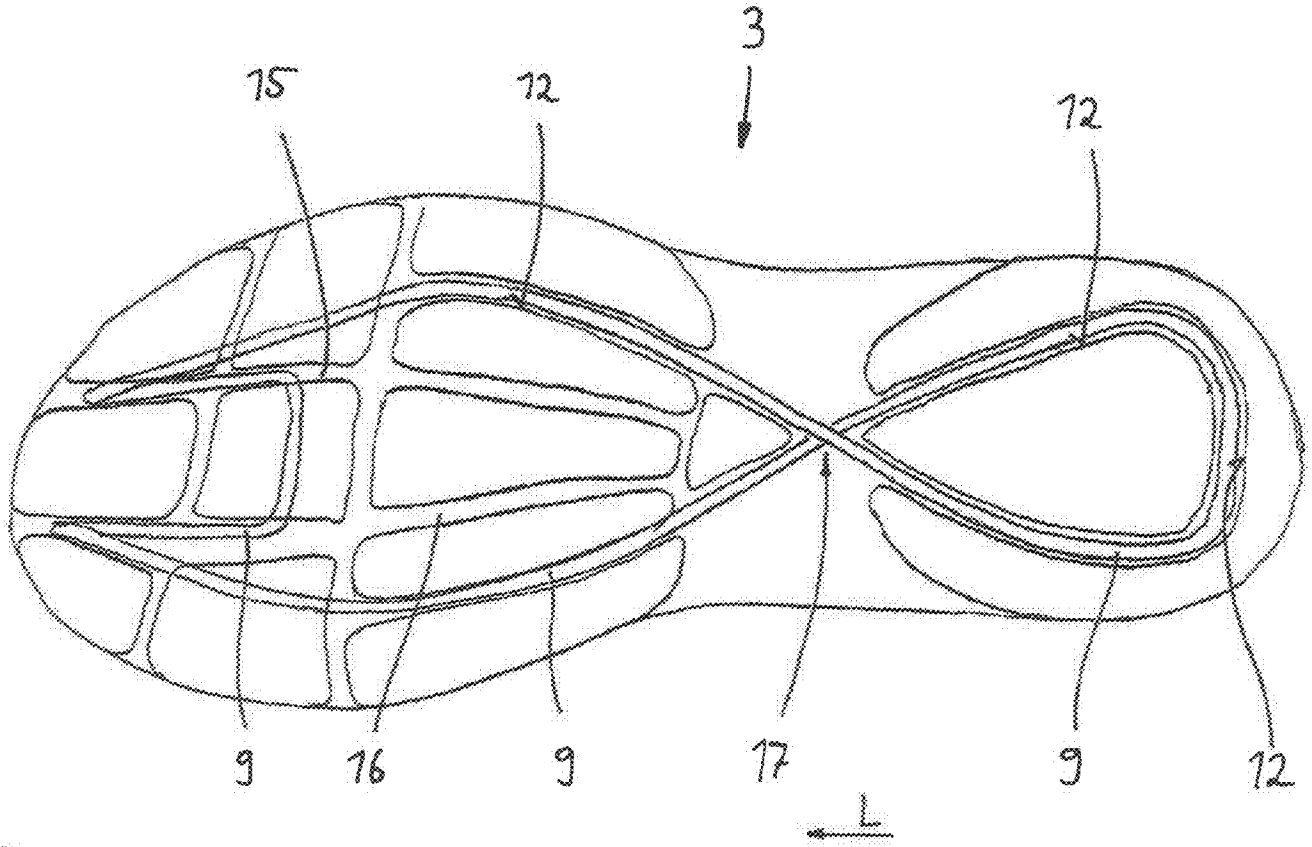
Figure 12:
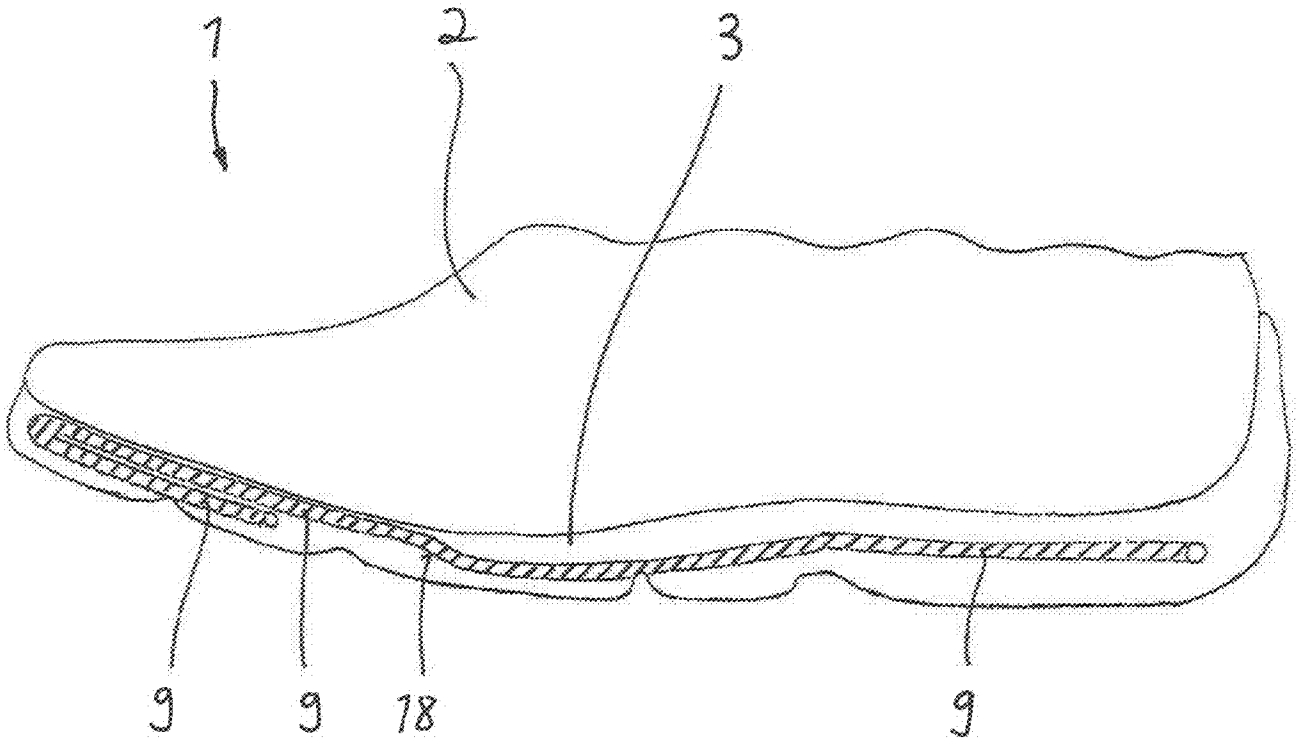
Figure 13:
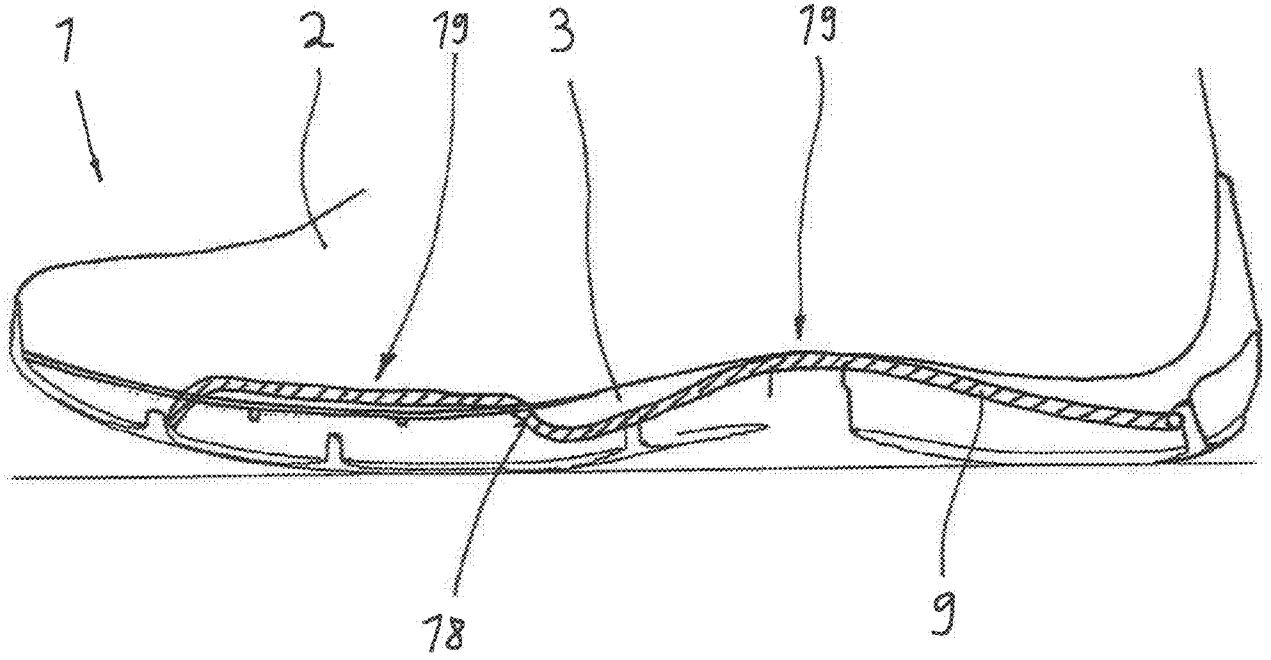
Figures 14A, 14B, 14C:
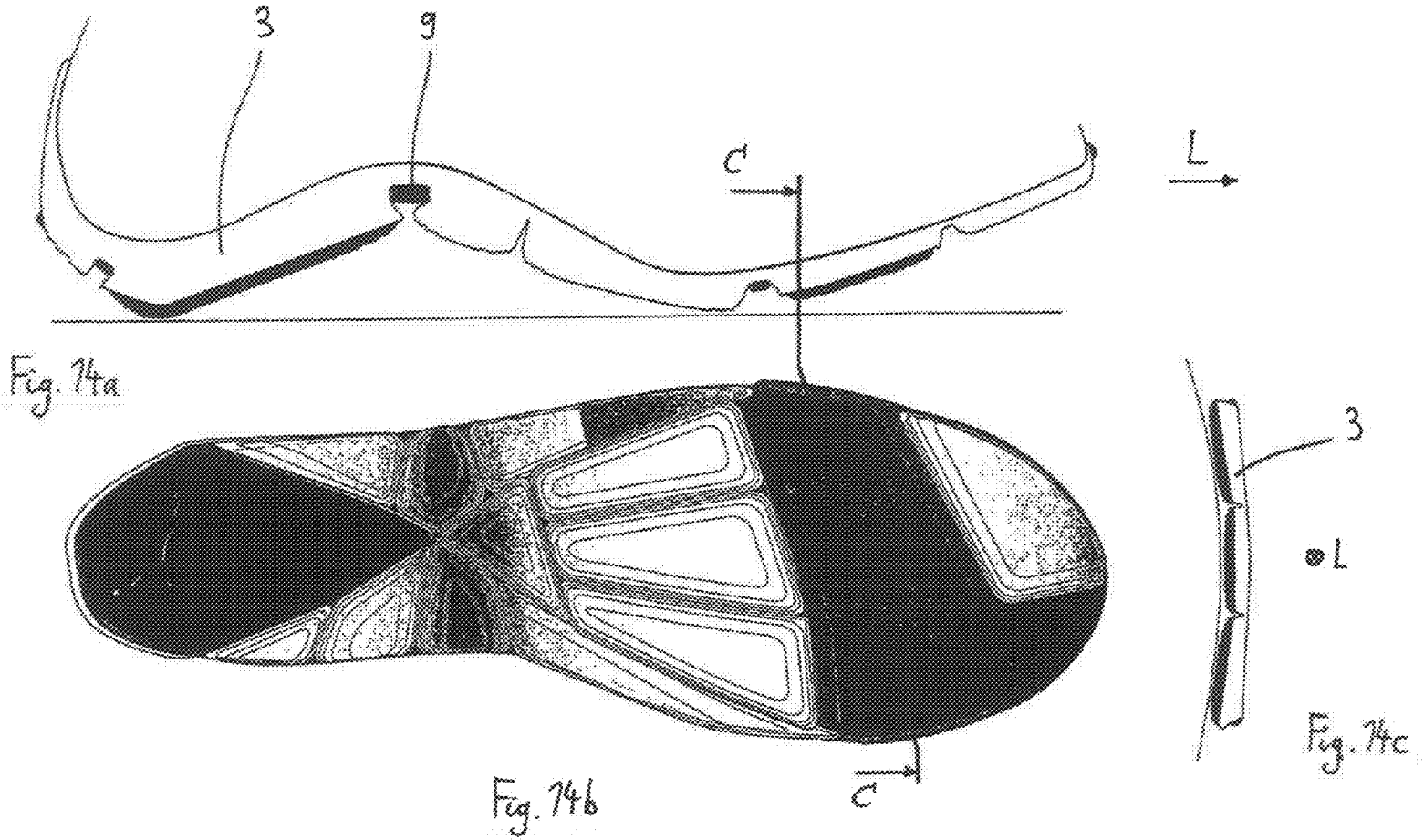
Figure 15A:
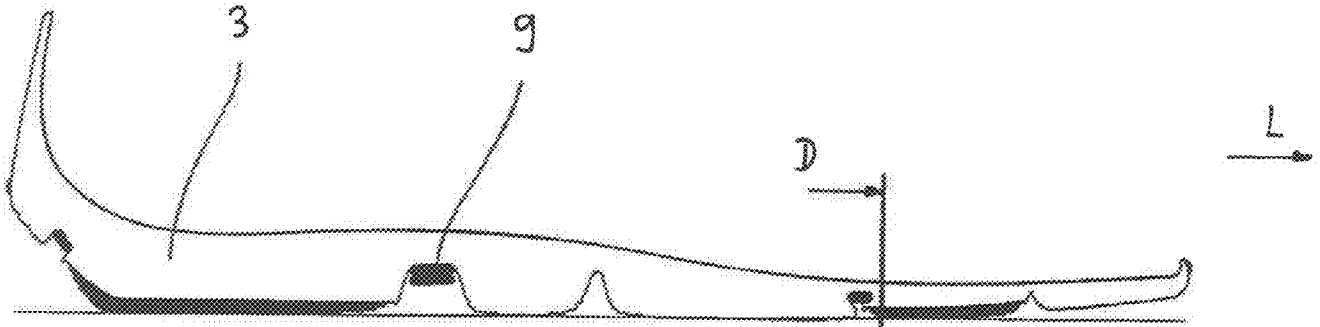
Figure 15B:
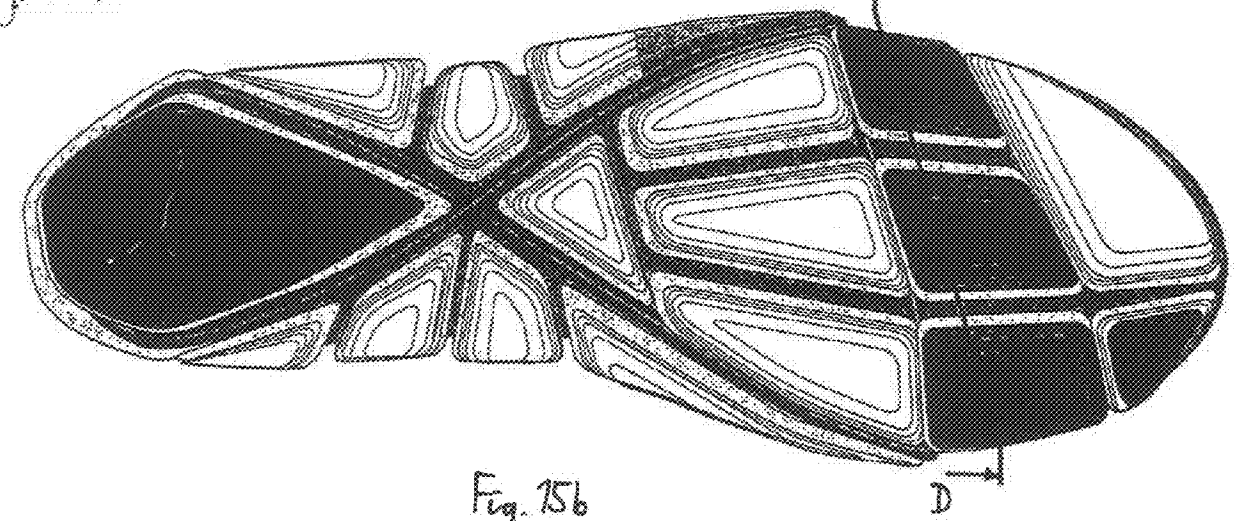
Figure 15C:
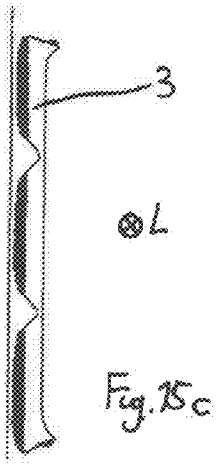

FIG. 1 shows schematically a sole of a shoe and the bones of a foot of a wearer of the shoe in a status free from external loads, FIG. 2 shows the same sole with bones according to FIG. 1 in a status in which the forces of the wearer of the shoe are acting on the sole, FIG. 3 shows schematically an illustration of the principle of the shoe according to the invention, wherein the shoe is in a status free from external loads, FIG. 4 shows the illustration according to FIG. 3, wherein the forces of the wearer of the shoe are acting on the sole, FIG. 5*a* shows a sectional side view of a first embodiment of the shoe according to the invention, wherein the shoe is in a status free from external loads, FIG. 5*b* shows mirrored the side view according to FIG. 5*a*, wherein the forces of the wearer of the shoe are acting on the sole, FIG. 6 shows the section A-A through the sole according to FIG. 5*a*, FIG. 7 shows the section B-B through the sole according to FIG. 5*a*, FIG. 8 shows the top plan view onto the bottom of the sole of the shoe for a second embodiment of the shoe according to the invention, FIG. 9 shows schematically a sectional side view of the shoe and sole respectively according to FIG. 8 with the run of a rubber band, FIG. 10 shows the shoe and sole respectively according to FIG. 8 in a rear view, FIG. 11 shows the partially sectional top plan view onto the bottom of the sole of the shoe for a third embodiment of the shoe according to the invention, FIG. 12 shows schematically a partially sectional side view of the shoe according to FIG. 11, FIG. 13 shows schematically a partially sectional side view similar to FIG. 12 according to an alternative embodiment, FIG. 14*a* shows a sectional side view of a further embodiment of the shoe according to the invention, wherein the shoe is in a status free from external loads, FIG. 14*b* shows the top plan view onto the bottom of the sole of the shoe according to FIG. 14*a*, FIG. 14*c* shows the section C-C according to FIG. 14*a* and FIG. 14*b* respectively, FIG. 15*a* shows the sectional side view according to FIG. 14*a*, wherein the forces of the wearer of the shoe are acting on the sole, FIG. 15*b* shows the top plan view onto the bottom of the sole of the shoe according to FIG. 15*a* and FIG. 15*c* shows the section D-D according to FIG. 15*a* and FIG. 15*b* respectively.

In FIG. 1 and FIG. 2 a sole 3 of a shoe and the bones of a foot of a wearer of the shoe are shown in two different phases. FIG. 1 shows the situation when the shoe has not yet contact to the ground 10, i. e. forces from the foot of the wearer do not yet act on the shoe. FIG. 2 shows the situation when the shoe has contact with the ground 10 and a force F from the foot of the wearer is acting on the shoe and the sole 3 respectively.

The bones of the foot of the wearer of the shoe are marked with Ot for the Ossa tarsi, Me for the Metatarsalia, Pp for the Phalanges proximales and Pd for the Phalanges distales.

The sole 3 has a forefoot region 4, a midfoot region 5 and a rearfoot region 6. It can be said that the forefoot region 4 extends along about the front 20% to 30% of the whole length of the sole $L_S$ (see FIG. 5*a*). The rearfoot region 6 extents along about the rear 10% to 20% of the length of the sole $L_S$. Between the forefoot region 4 and the rearfoot region 6 the midfoot region is extending. Two adjacent parts 5*a* and 5*b* of the midfoot region 5 are depicted in the figures.

By reducing the cross section, i. e. thickness of the sole 3 a first binge 7 is created between the forefoot region 4 and the midfoot region 5. In an analogous way a second hinge 8 is created in the sole 3 between the two parts 5*a* and 5*b* of the midsole region 5. The two hinges 7, 8 allow a relative pivot movement between the regions which are connected by the hinges; thus first and second horizontal axes $T_1$ and $T_2$ are established for the mentioned pivot movements.

By comparing FIG. 1 with FIG. 2 it becomes apparent that the form of the shoe and the sole 3 respectively changes significantly in the two situations.

In the loadfree status according to FIG. 1 the forefoot region 4 shows upwards form the ground 10, i. e. when regarding a tangent 11 of the bottom surface of the sole 3 in the forefoot region 4 an angle $\alpha$ is enclosed between the tangent 11 and the ground 10, which is in the present case about 30°. Also, the bottom surface of the midfoot region 5 and more specifically the two adjacent parts 5*a* and 5*b* of the midfoot region 5 are formed arch-shaped and define a radius of curvature R. This radius R is about 30% of the length $L_S$ of the sole 3 in the present case.

This changes totally when the shoe and sole 3 respectively contacts the ground 10 as can be seen in FIG. 2. Now due to a respective pivot movement around the axes $T_1$ and $T_2$ the angle $\alpha$ has reached almost 0° and also the radius of curvature R increased significantly, so that the whole sole 3 stands basically flat at its bottom side on the ground 10.

If the shoe is deloaded from the force F it takes again the position according to FIG. 1 due to an elastic tensioning element 9 which is not shown in FIG. 1 and FIG. 2. This is shown schematically in FIG. 3 and FIG. 4, again for the loadfree status (FIG. 3) and to loaded status (FIG. 4).

FIG. 3 and FIG. 4 show a kinematic substitution model of the sole. FIG. 3 corresponds to FIG. 1, i. e. no external forces are acting onto the shoe. In FIG. 4 the force F acts onto the shoe and deforms it.

According to FIG. 3 an elastic tensioning element 9 (rubber band) biases the sole so that an arch-shaped form is generated below the bones of the Ossa tarsi. At the same time the forefoot region is pulled upwards. It should be noted that the depiction is only schematic. The exact guidance of the rubber band 9 is done in that manner that the mentioned effect is reached.

In FIG. 4 it can be seen that the external force F deforms the sole in such a manner that the different parts of the sole are pivoted around the axes $T_1$ and $T_2$.

A first concrete embodiment of the invention is shown in FIG. 5, FIG. 6 and FIG. 7. In upper FIG. 5*a* a loadfree status (without external force F) of the shoe is shown; the mirrored depiction according to FIG. 5*b* shows the same shoe but now under the load of the force F (according to FIG. 2). The whole length of the sole 3 and the shoe respectively is denoted with $L_S$ and is measured in the direction of the longitudinal axis L.

In FIG. 5*a* it can be seen again that the forefoot region 4 is pulled upwards by the rubber band 9 which is incorporated into the sole 3 so that the tangent 11 encloses the angle $\alpha$ with the ground 10 (about 25° in the embodiment). Also, the radius of curvature R is delimited by the parts 5*a* and 5*b* of the midfoot region 5 (R is about 25% of the length $L_S$). In the loaded status—according to FIG. 5*b*—the bottom of the sole is substantially flat, i. e. the angle $\alpha$ is almost zero and the radius R becomes very big.

In FIG. 5*a*, 5*b* is can also be seen that in total four distinct hinges 7, 8, 13, and 14 are created by a respective thickness reduction of the sole 3. Consequently four horizontal axes $T_1$, $T_2$, $T_3$, and $T_4$ are created around which a relative pivot movement is possible. It should be noted that due to the fact that the whole sole construction is made of plastic material a deformable design is created at all when it comes to the deformability of the sole 3. In spite, the mentioned hinges 7, 8, 13, 14 reduce the bending stiffness of the sole at the respective locations in such a manner that a pivoting can take place in an easier manner, compared with the rest of the sole. The bending stiffness of the sole for bending the sole around the axes T at the locations of the hinges is 33%, preferably 25%, or less compared with the bending stiffness laterally to the hinge sections.

The rubber band 9 is guided in the sole in such a manner that the mentioned pre-load is created in the sole to bias the different regions of the sole as explained. This can be seen in the three FIGS. 5, 6, and 7 where the respective location of the rubber band 9 becomes apparent.

This can also be seen in FIGS. 8, 9, and 10 where a second embodiment of the shoe according to the invention is shown. The rubber band 9 is guided substantially in the form of an "eight" as can be seen from FIG. 8. A crossing location 17 is arranged in the midfoot region 5. The rubber band 9 runs around the heel of the sole 3 in the rearfoot region 6—see FIG. 10—and is guided in grooves 12 which are formed in the bottom side of the sole 3 to the forefoot region 4. As can be seen in FIG. 9 the rubber band 9 is guided to the tip portion of the forefoot region 4 and is turned, i. e. redirected there to run back a certain distance being arranged in the shoe upper part.

An alternative third embodiment of the shoe 1 according to the invention can be seen in FIG. 11 and FIG. 12. Basically the guidance of the rubber band 9 is similar to the second embodiment according FIGS. 8 to 10. Now, the rubber band 9 is guided in the rearfoot region 6 in a circular shaped groove 12 and runs form there similar to the shape of an "eight" to the forefoot region 4. Again, the rubber band 9 is turned in the tip portion of the forefoot region 4. The redirected portion of the rubber band 9 is now guided back below the rubber band 9 which is coming from the rear part of the sole 3, as can be seen in FIG. 12.

The length of the redirected, i. e. turned part of the rubber band 9 (both for the embodiments according to FIG. 9 and FIG. 12) is about 15% to 33% of the length $L_S$ measures in the direction of the longitudinal axis L. By doing so the desired biasing effect is optimized.

With regard to FIGS. 8 and 11 it should be mentioned that additional grooves 15 and 16 which are formed in the bottom surface of the sole 3 are arranged which run substantial in the direction of the longitudinal axis L. By those grooves the different parts of the sole which are created beside the grooves 15, 16 can pivot around an axis which runs parallel to the longitudinal axis L. So, the sole can better adapt the form of the ground.

With regard to the rim of the rubber band 9—seen in a side view and concerning the height of the band 9 above the ground 10—it has to be said that the exact run of the band 9 is done in such a way that the desired biasing effect takes duly place, i. e. respective lever arms of the force of the rubber band are given. While the rubber band 9 is guided in the rearfoot region 6 and the midfoot region 5 substantially quite close to the bottom surface of the sole 3 (namely in the optional "eight" shaped groove in the bottom surface of the sole) it can be guided somewhat higher in the forefoot region 4. Reference is made to FIG. 12 and the guide channel 18 which is formed in the sole 3 and which leads the rubber band 9 (shown with dashed lines) in a somewhat higher level in the sole 3 when it reaches the forefoot region 4.

In general, the rubber band is transferred between the bottom surface and the top surface of the sole in a suitable manner so that respective torques are generated by the rubber band for exerting the bending and biasing effect in the sole.

This can also be seen from FIG. 13, where an alternative solution to FIG. 12 is shown. The rubber band 9 is again shown with dashed lines. Here, a high level 19 is marked in the forefoot region and in the midfoot region where the rubber band 9 is guided relatively high so that it can exert the desired torque onto the sole to pull the sole and thus the shoe into the position shown in FIG. 5*a*.

In FIGS. 14 and 15 a further aspect of the invention is shown: When the sole 3 is regarded in the longitudinal direction (see specifically FIG. 14*c* and FIG. 15*c*) it becomes apparent that also seen in this direction a pre-forming of the sole is done. In FIGS. 14*a*, 14*b*, and 14*c* the situation is depicted when the shoe if free from external loads, e. g. when it has no ground contact. Thus, a similar situation is observed with respect to the side view as e. g. in FIG. 5*a*. When seen in longitudinal direction L the sole 3 has a concave shape at its bottom side (see FIG. 14*c*). Hence, the bottom of the sole is negatively curved in the transverse arch area when no downward load is applied to the shoe. Only when load is applied to the shoe, i. e. when ground contact is given and the weight of the wearer of the shoe acts onto the sole 3, the bottom of the sole 3 is flat in the transverse arch area as can be seen from FIG. 15*c*.

When it comes to the production of the shoe a last is employed. The shoe is built around the last which is a model of the human foot. Usually, a last is used which is based on a human foot in a hanging position, which is the same as during the swing phase of running. In the present case a last is used which form corresponds to the shoe according to FIG. 5*a*, i. e. the last is carved out in the arc section and has a high toe-spring.

REFERENCE NUMERALS

1 Shoe
2 Shoe upper
3 Sole
4 Forefoot region
5 Midfoot region
5*a* Park of the midfoot region
5*b* Part of the midfoot region
6 Rearfoot region
7 First hinge
8 Second hinge
9 Elastic tensioning element (rubber band)
10 Ground
11 Tangent
12 Channel/Groove
13 Third hinge
14 Fourth hinge
15 Groove
16 Groove
17 Crossing location
18 Guide channel
19 High level
L Longitudinal axis
$L_S$ Length of the sole
$T_1$ First horizontal axis
$T_2$ Second horizontal axis
$T_3$ Third horizontal axis
$T_4$ Fourth horizontal axis
$\alpha$ Angle
R Radius of curvature
F Force
Ot Ossa tarsi
Me Metatarsalia
Pp Phalanges proximales
Pd Phalanges distales

The invention claimed is:

1. A shoe comprising:

a shoe upper and a sole which is connected with the shoe upper, wherein the sole has a longitudinal axis and has a forefoot region, a midfoot region and a rearfoot region, at least one first hinge is provided in the sole being located between the forefoot region and the midfoot region, which first hinge allows a bending of the forefoot region relatively to the midfoot region around a first horizontal axis perpendicular to the longitudinal axis, at least one second hinge is provided in the sole being located in the midfoot region, which second hinge allows a bending of two adjacent parts of the midfoot region around a second horizontal axis perpendicular to the longitudinal axis, at least one elastic tensioning element is arranged at or in the sole, which biases the forefoot region to pivot around the first horizontal axis upwards relatively to the midfoot region when the shoe is standing on the ground and which biases the two parts of the midfoot region to pivot around the second horizontal axis to form an arch when the shoe is standing on the ground.

2. The shoe according to claim 1, wherein the tensioning element is a rubber band.

3. The shoe according to claim 2, wherein the rubber band has a circular cross section.

4. The shoe according to claim 3, wherein the rubber band has a diameter between 2 mm and 7 mm.

5. The shoe according to claim 2, wherein the rubber band is guided at least partially in channels or grooves which are formed in or on the sole.

6. The shoe according to claim 2, wherein the rubber band is guided substantially in the shape of an eight seen in a top plan view of the sole.

7. The shoe according to claim 1, wherein the rubber band is guided from the rearfoot region to the front end of the sole, wherein the rubber band is turned at the front end of the sole and runs back in the direction of the rearfoot region along a defined extension.

8. The shoe according to claim 7, wherein the turned rubber band is running below the rubber band coming from the rearfoot region.

9. The shoe according to claim 7, wherein the turned rubber band is running in or on the shoe upper.

10. The shoe according to claim 2, wherein the rubber band is a closed band.

11. The shoe according to claim 1, wherein the forefoot region has a tangent in the front end of the sole seen in a side view, wherein an angle is arranged between the tangent and the ground, which angle is between 15° and 40°, when the shoe is in a loadfree status and standing on the ground.

12. The shoe according to claim 1, wherein the two adjacent parts of the midfoot region limit a radius of curvature, wherein the radius of curvature is between 15% and 35% of the length of the sole, when the shoe is in a loadfree status and standing on the ground.

13. The shoe according to claim 1, further comprising at least one third hinge is arranged in the forefoot region, which third hinge allows a bending of sections of the forefoot region relatively to another around a third horizontal axis perpendicular to the longitudinal axis.

14. The shoe according to claim 1, further comprising at least one fourth hinge is arranged in the midfoot region, which fourth hinge allows a bending of sections of the midfoot region relatively to another around a fourth horizontal axis perpendicular to the longitudinal axis.

15. The shoe according to claim 1, wherein the sole has at least one further groove being formed in the bottom surface of the sole and running substantial in the longitudinal direction of the shoe, which groove forms a hinge for pivoting a part of the sole relatively to another part of the sole around the longitudinal direction of the shoe.

* * * * *